US005623271A

United States Patent [19]

Ponnapalli

[11] Patent Number: 5,623,271

[45] Date of Patent: Apr. 22, 1997

[54] LOW FREQUENCY PLANAR ANTENNA WITH LARGE REAL INPUT IMPEDANCE

[75] Inventor: Saila Ponnapalli, Fishkill, N.Y.

[73] Assignee: IBM Corporation, Armonk, N.Y.

[21] Appl. No.: 634,368

[22] Filed: Apr. 18, 1996

Related U.S. Application Data

[63] Continuation of Ser. No. 334,293, Nov. 4, 1994, abandoned.

[51] Int. Cl.[6] ..... H01Q 1/36

[52] U.S. Cl. ..... 343/895; 343/846

[58] Field of Search ..... 343/895, 846; H01Q 1/36

[56] References Cited

U.S. PATENT DOCUMENTS

| | | | |
|---|---|---|---|
| 4,032,921 | 6/1977 | Sikina, Jr. et al. | 343/895 |
| 4,630,064 | 12/1986 | Andrews et al. | 343/895 |
| 5,170,175 | 12/1992 | Kabus et al. | 343/895 |
| 5,313,216 | 5/1994 | Wang et al. | 343/895 |

*Primary Examiner*—Donald T. Hajec
*Assistant Examiner*—Tan Ho
*Attorney, Agent, or Firm*—Whitham, Curtis, Whitham & McGinn; Robert P. Tassinari, Jr.

[57] ABSTRACT

There is disclosed a planar antenna for very low frequencies. The antenna has a high impedance and can be matched to 50 ohm or higher impedance stages. The antenna may be used for applications which require a short range such as a wireless peripheral. The antenna operates only in its near-field and does not require a complex lossy impedance matching network, since the input impedance is large.

2 Claims, 6 Drawing Sheets

LOW FREQUENCY PLANAR ANTENNA WITH LARGE REAL INPUT IMPEDANCE

This is a Continuation of application Ser. No. 08/334,293, filed on Nov. 4, 1994, now abandoned.

BACKGROUND OF THE INVENTION

1. Field of the Invention

The present invention generally relates to radio frequency antennas and, more particularly, to planar antennas for very low frequency, short range (near field) applications.

2. Description of the Prior Art

Antennas which function at low radio frequencies (RF) are now required for wireless devices, such as wireless peripherals. One example of a proposed application for a low frequency antenna is a wireless keyboard for a computer workstation. Such a keyboard eliminates the cable interconnecting a conventional keyboard with the system unit, providing the user with more freedom of placement of the keyboard. Infrared (IR) transmitters have been used for wireless keyboards, but while eliminating the cable, these require that there be a clear optical path between the keyboard and the system unit. Other peripherals which are candidates for wireless interconnections are printers, modems and local area networks (LANs), all of which would benefit from an elimination of the cabling usually associated with such devices and systems.

These wireless applications are all characterized by low power output and, therefore, low range (typically near field) communications. At frequencies such as 49 Mhz, the wavelength is 6.12 meters in free space. A monopole can be designed with many windings in order to create a quarter wavelength antenna. However, this may not be a desirable form factor from an aesthetic sense. Generally, it is desirable to conceal the antenna in the device packaging so that it is not visible. Furthermore, a monopole antenna can break off easily, making it undesirable from a reliability point of view. If an electrically small antenna were used, the input impedance would be capacitive, and the real part of the impedance would be very small. A matching network would have to be designed to match the previous stage, and much of the power would be lost in the matching network.

SUMMARY OF THE INVENTION

It is therefore an object of the present invention to provide a mechanically compact antenna structure which provides a large real input impedance to a transmitter.

It is another object of the invention to provide a low frequency RF antenna which is physically small and economical to manufacture.

It is further object of the invention to provide an RF antenna for short range (near field) applications which is both compact in size and has a large real impedance.

According to the invention, there is provided a planar antenna having a low profile allowing it to be embedded in the packaging of the device to which it is attached. This is useful for applications such as a wireless keyboard and other computer peripherals mentioned above. The planar antenna design of the invention resonates at very low frequencies while still having a small form factor. The antenna is printed on a dielectric substrate, so that the effective dielectric constant is greater than air. The antenna can be tuned to the desired frequency so that its input impedance is real and large. The antenna operates only in its near-field, and therefore has a short range. This is useful for applications in which many RF devices must share the same frequencies, so that the range of operation of each device, or "cell" must be spatially separated.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
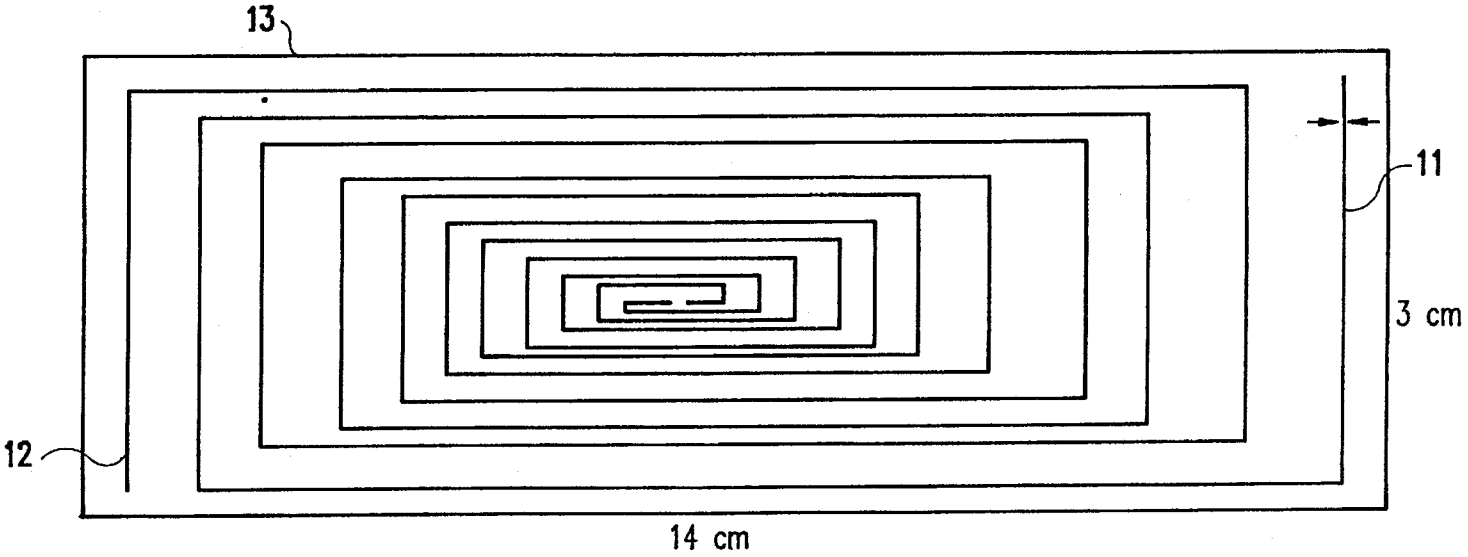
FIG. 1 is a plan view of the antenna of the present invention.

Referring now to the drawings, and more particularly to FIG. 1, there is shown a plan view of the antenna according to a preferred embodiment of the invention. The antenna is half a wavelength long, with two spiralled arms 11 and 12. By using a spiral geometry, the antenna can be made to fit in the required form factor.

Figure 2:
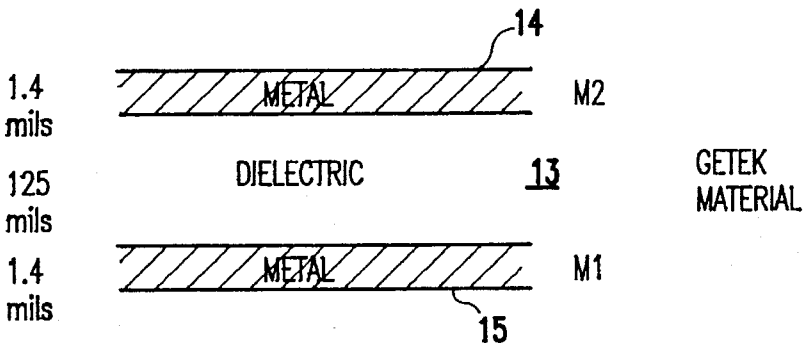
FIG. 2 is a cross-sectional view of the antenna shown in FIG. 1 showing a specific construction.

Referring now to both FIGS. 1 and 2, the antenna is formed on a substrate 13 having a length of 14 cm and a width of 3 cm. As shown in FIG. 2, the substrate 13 is 125 mil thick GETEK material, fabricated by General Electric, with a dielectric constant of 4.2. On the top surface of the substrate is the metalization 14 which defines the spiral geometry of the antenna. The bottom surface of the substrate is covered by metalization 15 which acts as a ground plane for the antenna. The metalizations 14 and 15 are typically 1.4 mils in thickness and formed by well known plating and etching techniques.

A crude calculation using a computed effective dielectric constant of 3.35 shows that each arm of the antenna should be 83.6 cm long to be a quarter wavelength. Due to coupling and fringing effects, the actual length of each arm was found to be 98.9 cm.

Figure 3:
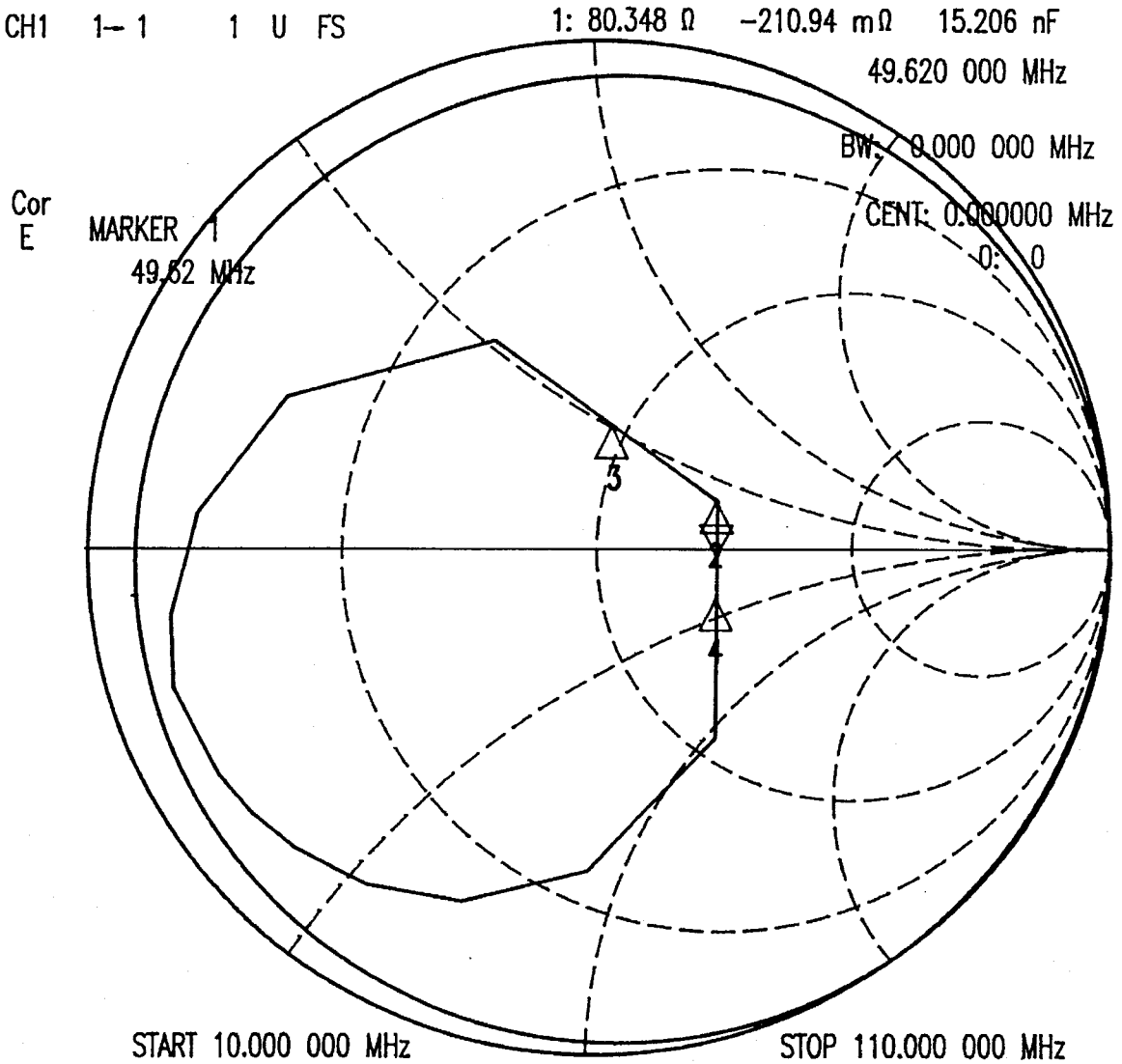
FIG. 3 is a Smith chart of the input impedance of the antenna.
Figure 4:
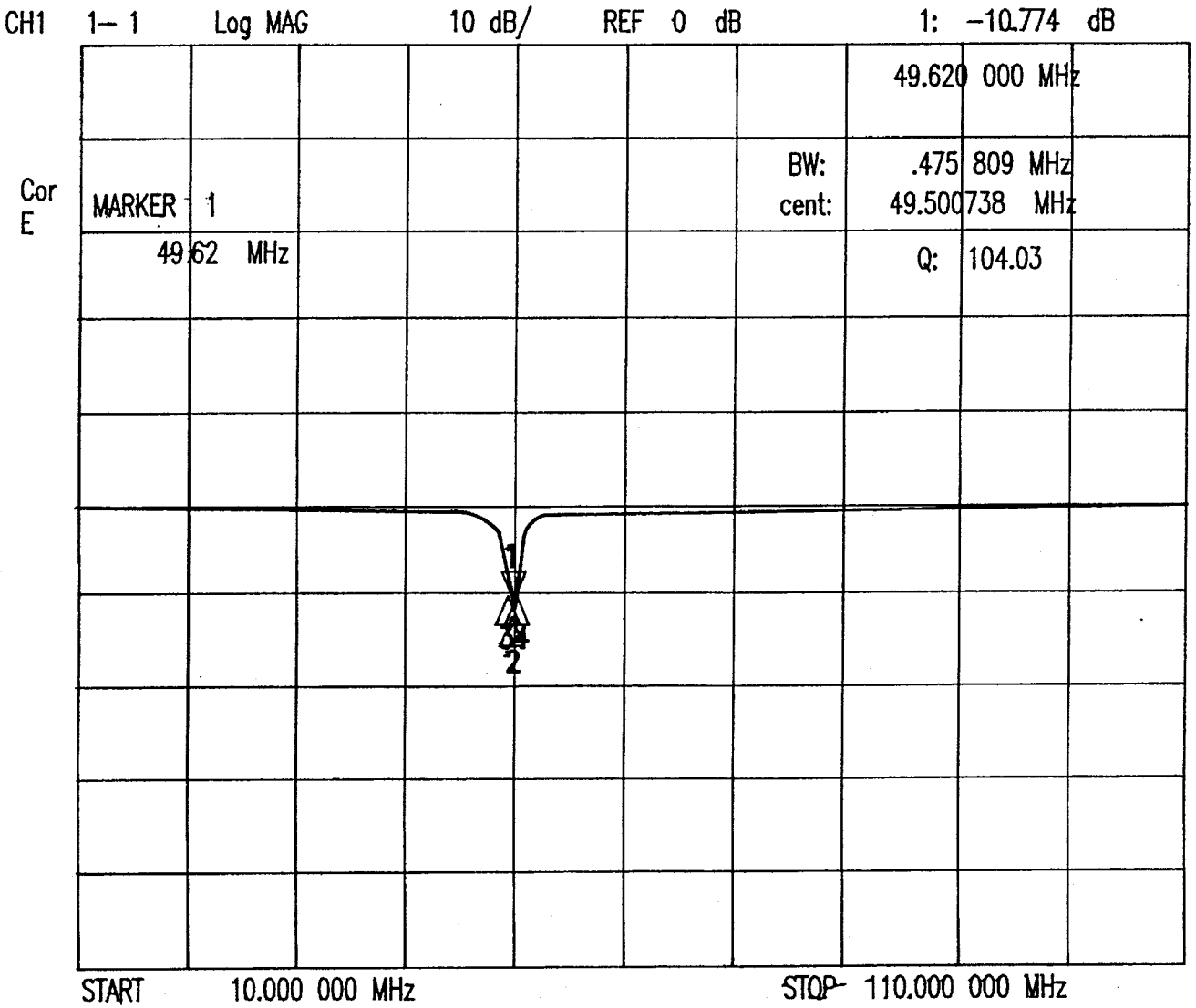
FIG. 4 is a graph showing the reflection coefficient of the antenna.

The antenna was fabricated and found to resonate at 49 MHz, with an input impedance measured at 80 ohms. FIG. 3 shows the input impedance on a Smith chart. As can be seen, the real part of the input impedance at 49 MHz is 80 ohms, while the imaginary part is negligible. FIG. 4 shows the reflection coefficient. The reflection coefficient indicates a voltage standing wave ratio (VSWR) of 1.0:2:0 in the 49 MHZ range.

Figure 5:
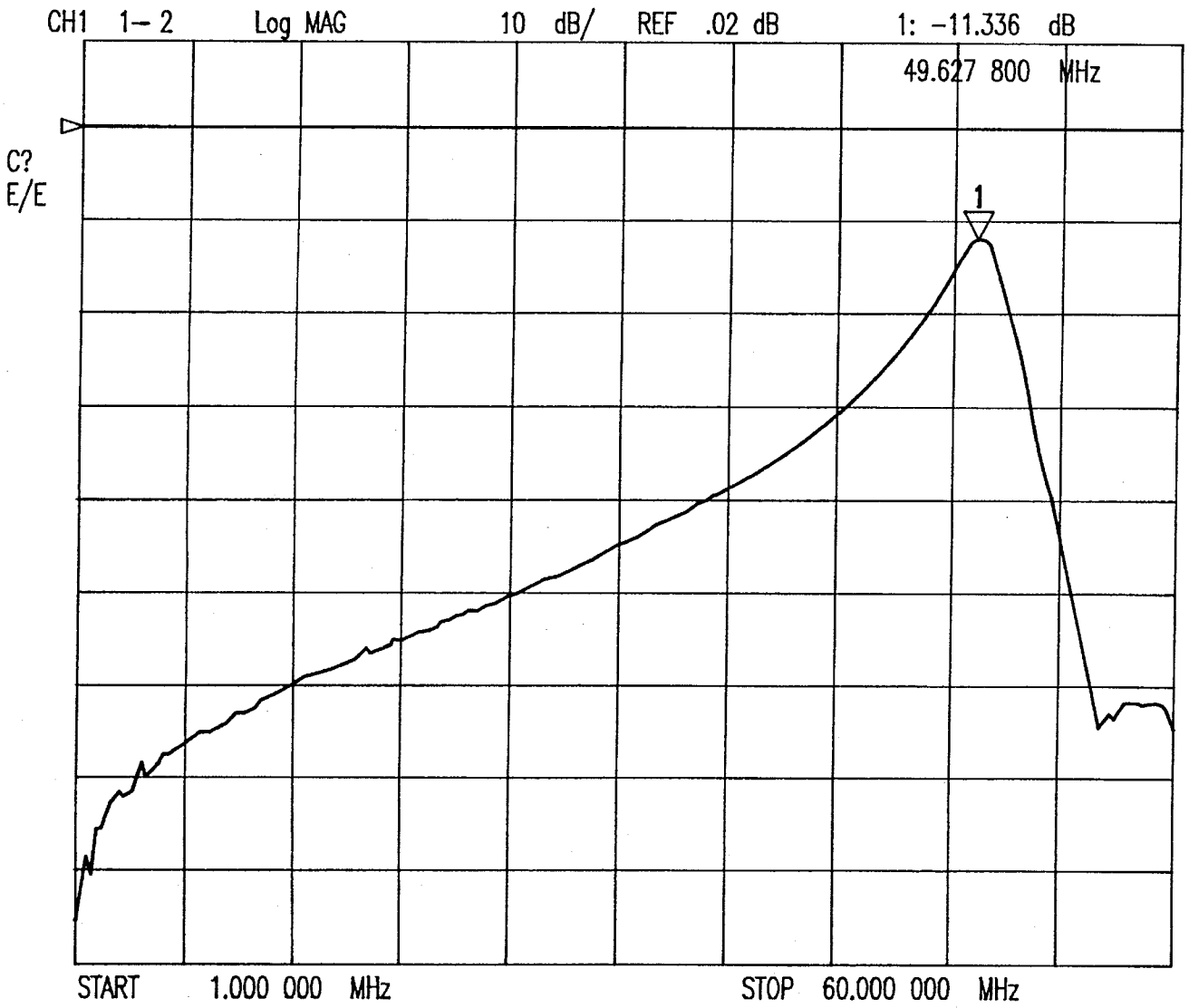
FIG. 5 is a graph of transmission as a function of frequency at one inch.
Figure 6:
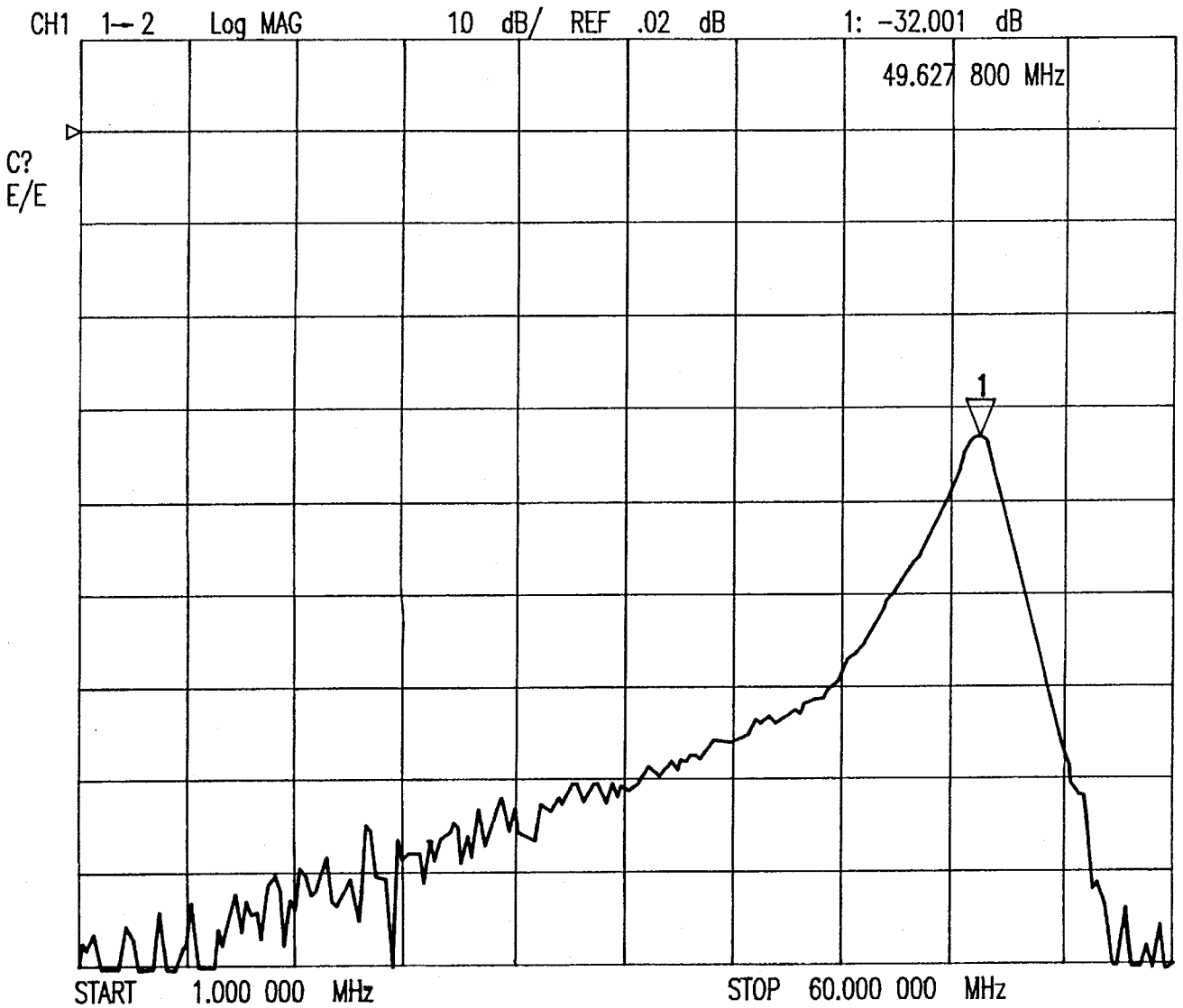
FIG. 6 is a graph of transmission as a function of frequency at one foot.
Figure 7:
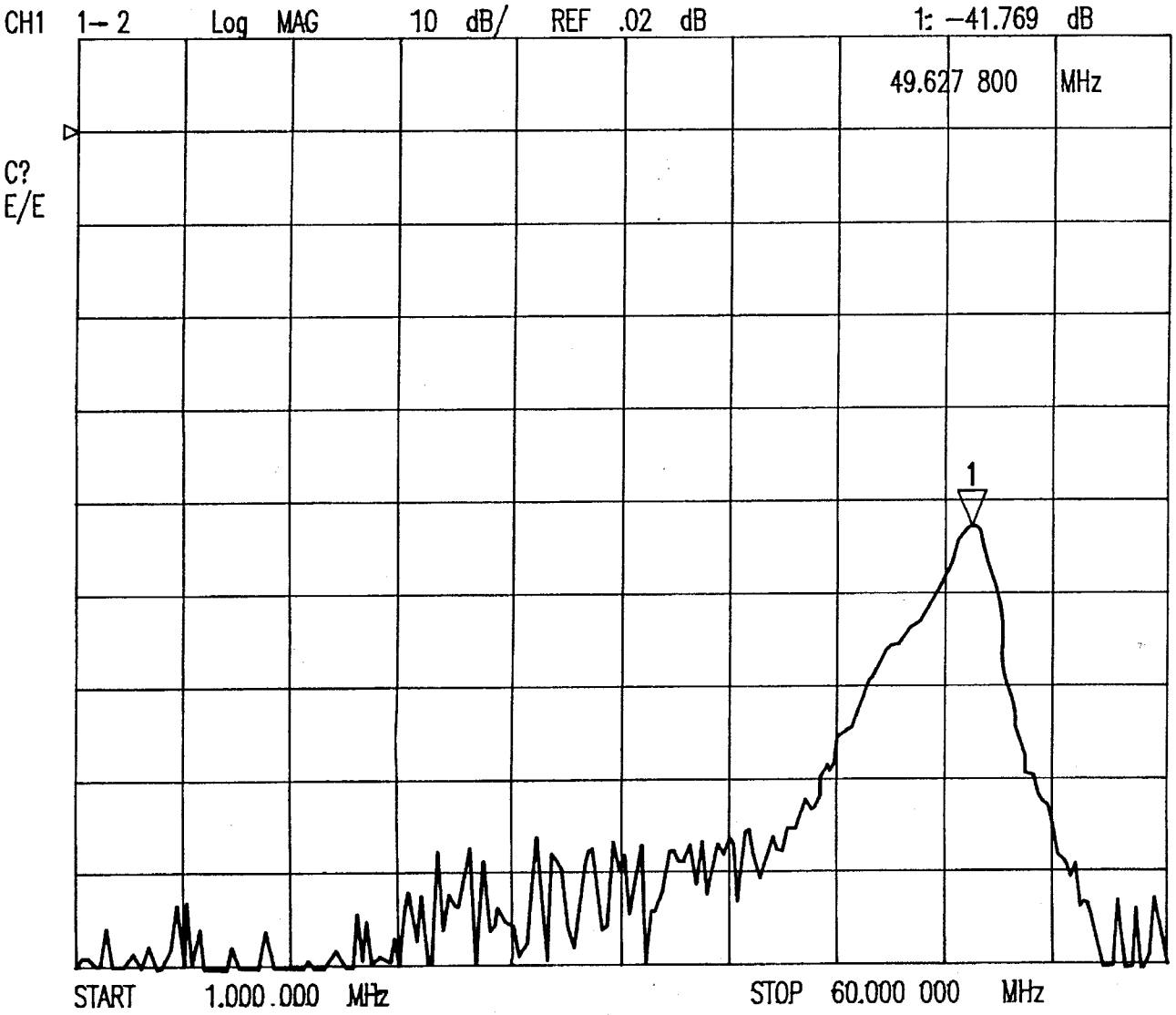
FIG. 7 is a graph of transmission as a function of frequency at two feet.

FIGS. 5 to 7 show normalized transmitted power (S12) as a function of frequency when the antennas are one inch, one foot, and two feet apart. At two feet, power transfer between antennas is achieved with a path loss of 40 dB. This is sufficiently high power for many radio designs. The impedance of the antenna can be matched to 50 ohms or higher using a simple matching network without significant loss of power.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A low power planar antenna for resonating at low radio frequencies and operating in near field applications, comprising:

a top layer of conductor consisting of two interwound spiral conductors, each conductor being approximately one quarter wavelength long at a center radio frequency of approximately 50 MHz;

a center layer of dielectric having dimensions of approximately 3 cm by 14 cm, a dielectric constant of approximately 4 and a thickness of approximately 125 mil, said thickness being much less than one quarter wavelength; and a bottom layer of conductor which is a solid conducting plane, said antenna having a high, real impedance, wherein the real impedance of the antenna is approximately 80 ohms, while an imaginary part of the antenna impedance is substantially negligible, the thickness of said antenna forcing the antenna to operated only in the near field.

2. A low power, short range planar antenna adapted for embedding in a peripheral package, said antenna resonating at low radio frequencies and operating in near field applications, comprising:

a thin rectangular dielectric substrate having dimensions of approximately 3 cm by 14 cm, a dielectric constant of approximately 4 and a thickness of approximately 125 mil, said thickness being much less than one quarter wavelength;

a patterned conductor on a first planar surface of said substrate consisting of two interwound spiral conductors, each conductor being approximately one quarter wavelength long at a center radio frequency of approximately 50 MHz; and a planar conductor froming a solid conducting plane on a second planar surface of said substrate said antenna having a high, real impedance, wherein the real impedance of the antenna is approximately 80 ohnms, while an imaginary part of the antenna impedance is substantially negligible, the thickness of said antenna forcing the antenna to operated only in the near field.

* * * * *